US011517089B2

(12) United States Patent
Dolah

(10) Patent No.: US 11,517,089 B2
(45) Date of Patent: Dec. 6, 2022

(54) HAIR ROLLER ASSEMBLY APPARATUS AND METHOD OF USE

(71) Applicant: Olga Hassan Dolah, Brooklyn, NY (US)

(72) Inventor: Olga Hassan Dolah, Brooklyn, NY (US)

( * ) Notice: Subject to any disclaimer, the term of this patent is extended or adjusted under 35 U.S.C. 154(b) by 551 days.

(21) Appl. No.: 15/668,591

(22) Filed: Aug. 3, 2017

(65) Prior Publication Data

US 2018/0078015 A1 Mar. 22, 2018

Related U.S. Application Data

(63) Continuation-in-part of application No. 15/271,209, filed on Sep. 20, 2016, now abandoned.

(51) Int. Cl.

| | |
|---|---|
| ***A45D 2/00*** | (2006.01) |
| ***A45D 2/24*** | (2006.01) |
| ***A45D 2/12*** | (2006.01) |

(52) U.S. Cl.

CPC ..... *A45D 2/2442* (2013.01); *A45D 2/12* (2013.01); *A45D 2/122* (2013.01); *A45D 2/2485* (2013.01)

(58) Field of Classification Search

CPC ... A45D 2/02; A45D 2/04; A45D 2/08; A45D 2/10; A45D 2/12; A45D 2/122; A45D 2/14; A45D 2/146; A45D 2/148; A45D 2/18; A45D 2/20; A45D 2/24; A45D 2/2407; A45D 2/2485; A45D 2/2442; A45D 2002/025

USPC ..... 132/245, 250, 255, 256, 261, 265

See application file for complete search history.

(56) References Cited

U.S. PATENT DOCUMENTS

| | | | | |
|---|---|---|---|---|
| 3,713,455 A * | 1/1973 | Chen | A45D 2/24 132/262 |
| 4,856,542 A | 8/1989 | Hollenberg et al. | |
| 5,901,711 A | 5/1999 | Jeremy | |
| 6,142,158 A * | 11/2000 | Lloyd | A45D 8/24 132/278 |

(Continued)

FOREIGN PATENT DOCUMENTS

WO 2016079334 A1 5/2016

OTHER PUBLICATIONS

International Search Report & Written Opinion for PCT/US2017/052596, dated Dec. 11, 2017.

*Primary Examiner* — Rachel R Steitz

(74) *Attorney, Agent, or Firm* — Intellent Patents LLC; Ahmed Alhafidh

(57) ABSTRACT

Embodiments of the present invention relate to a hair roller which can be separated into a pair of half-cylindrical roller pieces, pairs of half-cylindrical roller pieces, and a method of storing half-cylindrical roller pieces by nesting the half-cylindrical roller pieces. The hair roller of the invention includes a whole cylindrical body separable along a vertical axis into half-cylindrical roller pieces which include a plurality of mating devices configured to selectably couple the half-cylindrical roller pieces to form the whole cylindrical body, wherein the half-cylindrical roller pieces are capable of being nested. The pair of half-cylindrical roller pieces of the invention are identical in shape, which include a plurality of tabs and orifices, where the tabs have protuberances which protrude into a corresponding orifice when the lateral edges of the pair of roller pieces are aligned.

5 Claims, 11 Drawing Sheets

(56) References Cited

U.S. PATENT DOCUMENTS

| | | | | |
|---|---|---|---|---|
| 8,306,449 | B2 | 11/2012 | Stresau | |
| 8,342,189 | B2 | 1/2013 | Gregorek | |
| 8,544,476 | B1 | 10/2013 | Marquardt et al. | |
| 2010/0252062 | A1* | 10/2010 | Gregorek ..... | A45D 2/145<br>132/226 |

* cited by examiner

HAIR ROLLER ASSEMBLY APPARATUS AND METHOD OF USE

BACKGROUND

Hair rollers of various types are commonly used hair treatments to create permanent or temporary waves in hair. Through the application of heat and/or various chemical treatments, hair wrapped around a hair roller will take on a curled configuration. Most hair rollers are cylindrical in shape and either made of a porous sponge material or of a hollow tube with holes in the sides, to allow the passage of air through the rollers to facilitate drying of hair wrapped around each roller. The hair can be dried by exposing the hair wrapped rollers to air, which is usually ambient or hot. The air can be projected from a hand-held or stationary air source such as a hair dryer. Some hair rollers are designed to be heated, for example, by temporary insertion of a heating element into the center of a hollow cylindrical roller prior to use.

Hair rollers take up a lot of space. It typically takes twelve to twenty-five hair rollers at a time to set one individual's hair. For hair salons which service multiple individuals at a time, a large amount of storage space must be reserved for hair rollers. Furthermore, consumers who like to take their own hair rollers with them when they travel have difficulty finding space for the number of rollers they need in a purse, handbag, or other carrying case. In particular, when traveling via airplane, the increasingly stringent regulations governing carry-on items may necessitate having to transport hair rollers in checked baggage, which can result in excess baggage claim fees. Checked bags can also be delayed or even lost in transit.

What is needed are hair rollers that can be disassembled and stored in compact configurations, making them easy to transport and store. In order to be practical, such hair rollers must be easy to assemble and of a design that makes them cheap to manufacture. All those needs are met in the hair rollers of the present invention.

SUMMARY

The present invention has been developed in response to the present state of the art, and in particular, in response to the problems and needs in the art that have not yet been fully solved by currently available hair roller sets, devices, methods of storing, and methods of using the same. Accordingly, embodiments of the present invention relate to providing roller pieces which can be assembled to form a hair roller, hair rollers separable into roller pieces, and methods of storing the same. Rollers of the present invention can be readily assembled from the roller pieces of the invention, disassembled, stored, and/or reassembled by a consumer.

In some embodiments of the invention, there is a hair roller set configured to facilitate securing hair in a curled position during hair curling. The set includes a plurality of hair rollers that may each be disassembled into a pair of half-cylindrical roller pieces, and the roller pieces may be nested. The plurality of hair rollers may each include a flexible cylindrical body that may be substantially separated lengthwise such that the hair rollers may be disassembled into two symmetrical roller pieces with flexible half-cylindrical configurations and equal radii.

In some embodiments of the invention, the half-cylindrical roller pieces include mating devices configured to selectably couple the roller pieces together. Furthermore, the roller pieces may include mating guides that may be shaped to direct the roller pieces together when compression force is applied to the flexible half-cylindrical configurations of the roller pieces and/or it may be that the mating guides do not substantially restrict widening of the flexible half-cylindrical configurations of the roller pieces. In some embodiments of the invention, the half-cylindrical roller pieces are made of a flexible resilient material, preferably a plastic material. In some embodiments, the flexible half-cylindrical configurations of each of the roller pieces may be a single molded plastic device. The hair roller set may further include additional layers composed of different textures that may be coupled about the flexible cylindrical body of the assembled hair roller. The additional layer can be an adhesive or polyester foam. The hair roller of claim 1, wherein the outer surface has a texture designed to keep hair securely wrapped around the hair roller during a drying process.

In some embodiments, each mating device comprises a tab extending outward from the lateral edge of one half-cylindrical roller piece with a protuberance on a surface of the tab, and a corresponding orifice in the other half-cylindrical roller piece. In one embodiment, the protuberance has the same shape as the orifice, and the half cylindrical roller pieces are securely fastened together to form a whole cylindrical body when each protuberance is inserted into the corresponding orifice. In another embodiment, a proximal edge of the protuberance engages a distal edge of the corresponding orifice then tapers down to a distal end of the tab, which extends beyond a proximal edge of the corresponding orifice. In the last embodiment, the half-cylindrical roller pieces are securely fastened together to form a whole cylindrical body when the tabs are positioned on the interior, the protuberances protrude into the corresponding orifices, and the tabs extend through the corresponding orifice.

In another embodiment of the invention, a pair of half-cylindrical roller pieces configured as described above, can be assembled into a whole cylindrical hair roller.

In another embodiment, there is a method of storing half-cylindrical roller pieces of the invention by placing a surface of one half-cylindrical roller piece to face the outer surface of the other half-cylindrical roller piece so the and outer surfaces are exactly opposite each other. Multiple pairs of half-cylindrical roller pieces of the same size can be nested together in this way.

In yet another embodiment of the invention, there is a method of storing hair curling devices, comprising nesting two or more half-cylindrical roller pieces of the invention inside one another by aligning a first hair roller piece so the outer surface of the piece is adjacent to the inner surface of another and the lateral edges and ends are aligned, and pressing the two pieces together until the surfaces are close to or in contact with one another. Depending on their configuration, the roller pieces can nested together with little or no force applied. In order to ensure a compact configuration, the roller pieces can be nested together according to the steps of: widening a flexible half-cylindrical body of a first hair roller piece by applying force against a pair of faces formed along a lengthwise separation of the first hair roller piece, disposing a flexible half-cylindrical body of a second hair roller piece within an interior of the flexible half-cylindrical body of the first hair roller piece, thereby nesting the second hair roller piece within the first hair roller piece, widening the flexible half-cylindrical bodies of the first and second hair roller pieces, respectively, by applying force against the respective interior faces, and/or disposing a third hair roller piece within an interior of the second hair roller piece, thereby nesting the third hair roller piece within the first hair roller piece and directly within the second hair roller piece. In some embodiments of the invention, the nesting method outlined above can be applicable to an indefinite plurality of hair roller pieces. In some embodiments of the invention, the disassembled hair roller pieces can be loosely nested and/or stored in a separate container.

The assembled hair rollers of the invention can be any length or diameter, according to the needs of the consumer. In one embodiment of the invention, the diameter of a whole cylindrical body of an assembled hair roller is approximately 100 mm. In another embodiment of the invention, the diameter of a whole cylindrical body of an assembled hair roller is approximately 75 mm. In another embodiment of the invention, the diameter of a whole cylindrical body of an assembled hair roller is approximately 50 mm. In another embodiment of the invention, the diameter of a whole cylindrical body of an assembled hair roller is approximately 25 mm. In preferred embodiments of the invention, the outer surface of each disassembled hair roller piece includes protuberances akin to teeth. In some preferred embodiments of the invention, each of the protuberances are coupled to or adjacently located to an orifice the outer surface of each disass. The hair roller of claim 1, wherein the outer surface has a texture designed to keep hair securely wrapped around the hair roller during a drying process.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in celiain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE DRAWINGS

Each of the figures show two or more half-cylindrical roller pieces that are identical to one another in shape. Each feature or element is identified only once in each figure, although it may appear in more than one place on each hair roller piece shown.

Figure 1:
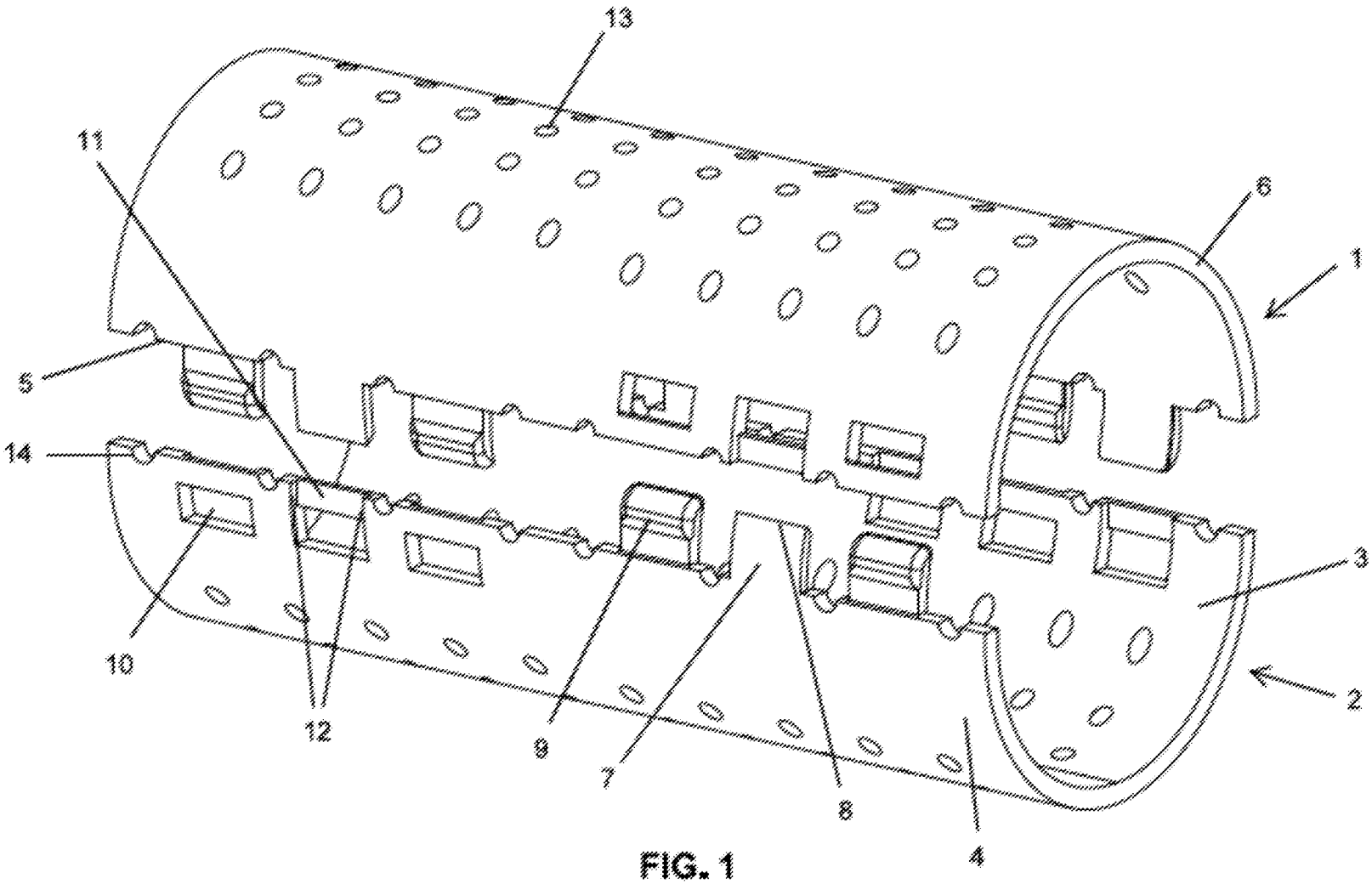
FIG. 1 is a side perspective view of a first embodiment of a hair roller of the invention in disassembled form, with two symmetrical half-cylindrical roller pieces with three tabs and three corresponding orifices on each side, with protrusions on different sides on adjacent tabs.

FIG. 1 illustrates a side perspective view of an example of a disassembled first embodiment of a hair roller of the invention separated into two component pieces, symmetrical half-cylindrical roller pieces 1 and 2. The hair roller has an inner surface 3 and an outer surface 4. Each half-cylindrical roller piece 1 and 2 has a lateral edge 5 on each side, and a half-circular end 6 at each end. Both half-cylindrical roller pieces 1 and 2 are identical. The half-cylindrical roller pieces 1 and 2 are shown separated by a gap. The hair roller includes mating devices that are configured to selectably couple the half-cylindrical roller pieces 1 and 2 together. Each mating device is composed of complementary "male" and "female" configurations to allow the component pieces to be securely fastened to form an assembled hair roller piece. Each "male" configuration comprises a tab 7 extending from the lateral edge 5 with a protuberance 9 on a surface of the tab 7 terminating at a distal edge 8 of the tab 7. The protuberance 9 optionally has a rounded surface. Each "female" configuration comprises an orifice 10 in the half-cylinder roller piece 1 or 2 near the lateral edge 5, wherein each tab 7 is configured so that the protuberance 9 on the surface of the tab 7 protrudes into a corresponding orifice 10, when both lateral edges 5 and the half-circular ends 6 of the half-cylindrical roller pieces 1 and 2 are aligned. Each orifice 10 is rectangular in shape, although it could be a different shape. Each protuberance 9 is designed to fit securely into each orifice 10 when inserted therein. Each half-cylindrical roller piece has three tabs 7, one of which has a protuberance 9 on the inner surface of the tab (partially visible in the back side of half-cylindrical roller piece 1), the other two of which have a protuberance 9 on the outer surface of the tab. Together, the two are designed to insert into the corresponding orifices 10 of the other half-cylindrical roller 1 or 2 like opposing teeth when the two half-cylindrical roller pieces 1 and 2 are aligned. The surface of each half-cylindrical roller piece 1 or 2 has a channel extending from each orifice to the lateral edge on the side where the protuberance protrudes into the orifice from the corresponding tab. The channel is defined by a ledge 11 and rails 12 on either side of the ledge 11, where the sides of the tab 7 fit in the channel, between the rails 12. The channel is preferably deep enough to enable the outer surface of each tab to be substantially flush with the outer surface 4 of the half-cylindrical roller piece to which it is attached, when the hair roller is assembled. Each half-cylindrical roller piece includes air holes 13 to allow air to pass through the hair roller to hair wrapped around the roller, during the drying process. The air holes 13 can be of any shape or size or distribution. The lateral edge 5 also optionally includes groves 14 which form additional holes in the assembled roller, when the lateral edges 5 of half-cylindrical roller pieces 1 and 2 are aligned.

Figure 2:
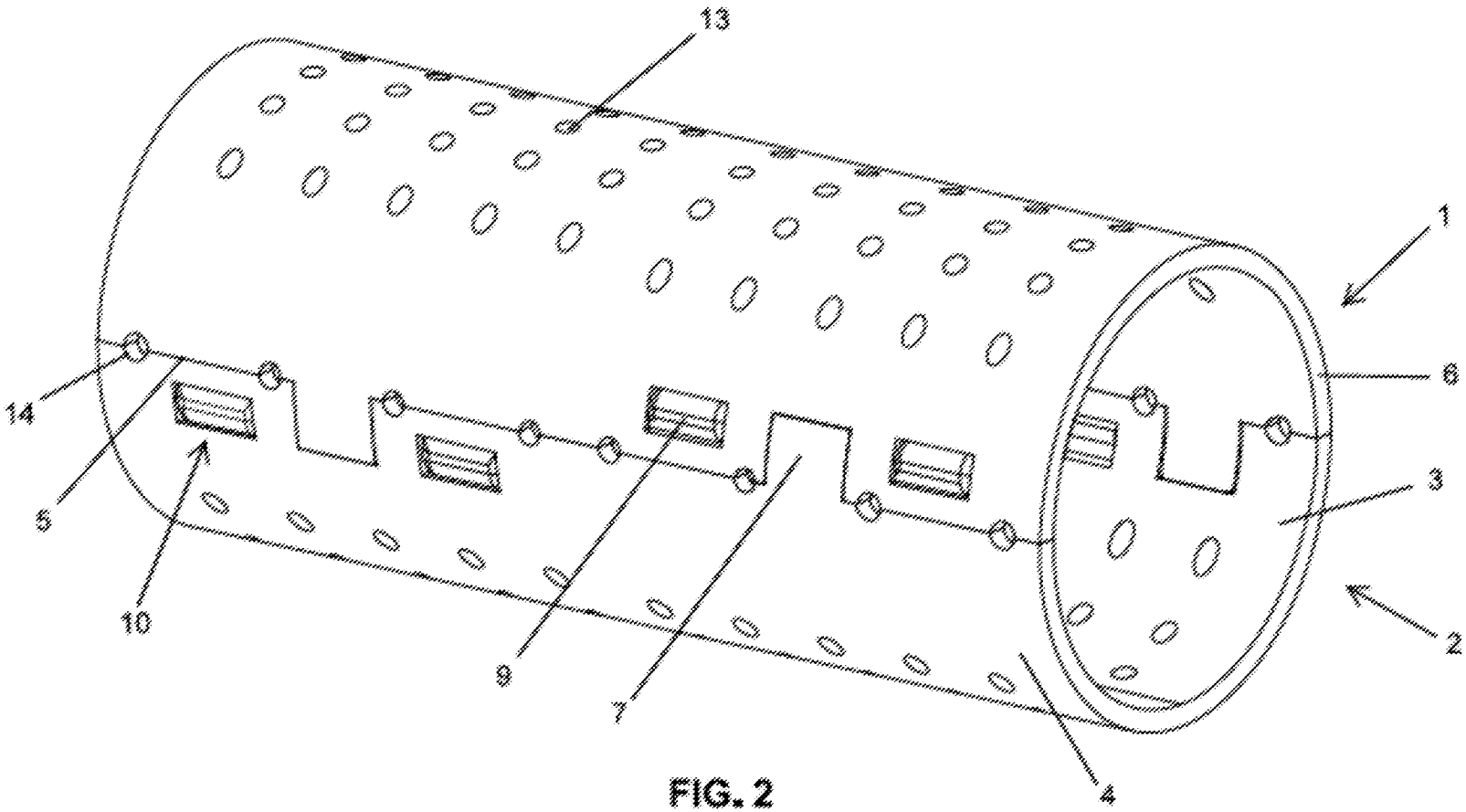
FIG. 2 is a side perspective view of the hair roller of FIG. 1 in assembled form.

FIG. 2 illustrates a side perspective view of the hair roller of FIG. 1 in an assembled configuration. Specifically, half-cylindrical roller pieces 1 and 2 are shown joined to form a single cylindrical hollow hair roller. The hair roller has an inner surface 3 and an outer surface 4. Each lateral edge 5 of half-cylindrical roller piece 1 is aligned with each lateral edge 5 of half-cylindrical roller piece 2, and the half-circular end 6 of half-cylindrical roller piece 1 is aligned with the half-circular end 6 of roller piece 2 to form a single circular end of the assembled roller. Half-cylindrical roller pieces 1 and 2 are securely attached to each other by the mating devices shown in disassembled form in FIG. 1. Each tab 7 extends from the lateral edge 5 of one half-cylindrical roller piece over a ledge 11 (covered by the tab) and corresponding orifice 10 in the other half-cylindrical roller piece, and the protuberance 9 at the distal edge 8 of each tab 7 protrudes into the corresponding orifice 10. Air holes 13 are present in the assembled roller, including additional air holes defined by groves 14 in the lateral edge 5 of the half-cylindrical roller pieces 1 and 2.

Figure 3:
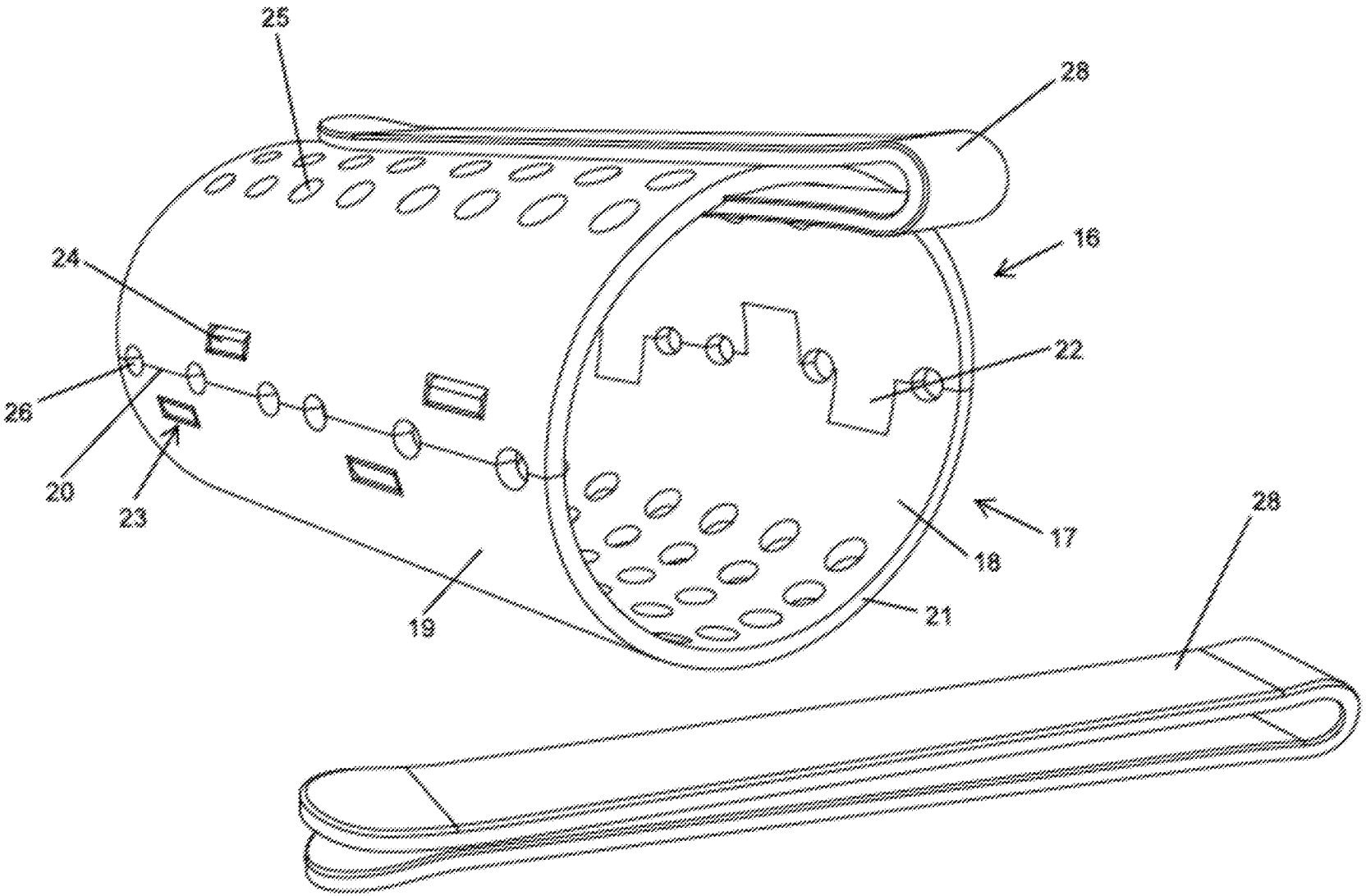
FIG. 3 is a side perspective view of a second embodiment of a hair roller of the invention, in assembled form, with two tabs and two orifices on each side, with optional clip attachments.

FIG. 3 is a perspective view of an example of a second embodiment of a hair roller of the invention in assembled form with optional clip attachments 28 to hold hair onto the roller when the hair is wrapped around the roller. Two half-cylindrical roller pieces 16 and 17 are symmetric components, half-cylindrical bodies, joined to form a single hair roller. Each half-cylindrical roller piece has an inner surface 18 and an outer surface 19. Each half-cylindrical roller piece 16 and 17 has a lateral edge 20 on each side, and a half-circular end 21 at each end. Both half-cylindrical roller pieces 16 and 17 are identical. The half-cylindrical roller pieces 16 and 17 include mating devices that are configured to selectably couple the hair rollers and their components together. Each device is composed of complementary "male" and "female" configurations to allow the component pieces to be securely fastened to form an assembled hair roller piece. The same type of mating device is used to fasten half-cylindrical roller pieces 16 and 17 as are used to fasten half-cylindrical roller pieces 1 and 2 in FIGS. 1 and 2. Specifically, each "male" configuration comprises a tab 22 extending from the lateral edge 20 with a protuberance 24 on a surface of the tab 22. Each "female" configuration comprises an orifice 23 in the half-cylinder roller piece 16 or 17 near the lateral edge 20, wherein each tab 22 is configured so that the protuberance 24 on the surface of the tab 22 protrudes into a corresponding orifice 23, when both lateral edges 20 and the half-circular ends 21 of the half-cylindrical roller pieces 16 and 21 are aligned. However, unlike half-cylindrical roller pieces 1 and 2, half-cylindrical roller pieces 16 and 17 only have two tabs 22 and two orifices 23 on each side, and the protuberances 24 are all on the outer surface of each tab 22. The half-cylindrical roller pieces 16 and 17 are preferably made of a resilient flexible material. Half-cylindrical roller pieces 16 and 17 also have air holes 25, and optional grooves 26 in each lateral edges 20 that define additional air holes when assembled.

The hair roller of FIG. 3 can readily be disassembled by pressing inward on the outer surface 19 of both half-cylinder roller pieces 16 and 17 at or near where the lateral edges 20 are joined until each protuberance 24 is removed from the corresponding orifice 23 and the half-cylindrical roller pieces 16 and 17 can be pulled apart. The hair roller of FIG. 3 can readily be assembled by aligning the lateral edges 20 with each tab 22 positioned below the inner surface 18 of the other half-cylindrical roller piece, and pressing outward on each tab 22 until each protuberance 24 is securely inserted into its corresponding orifice 24

Figure 4:
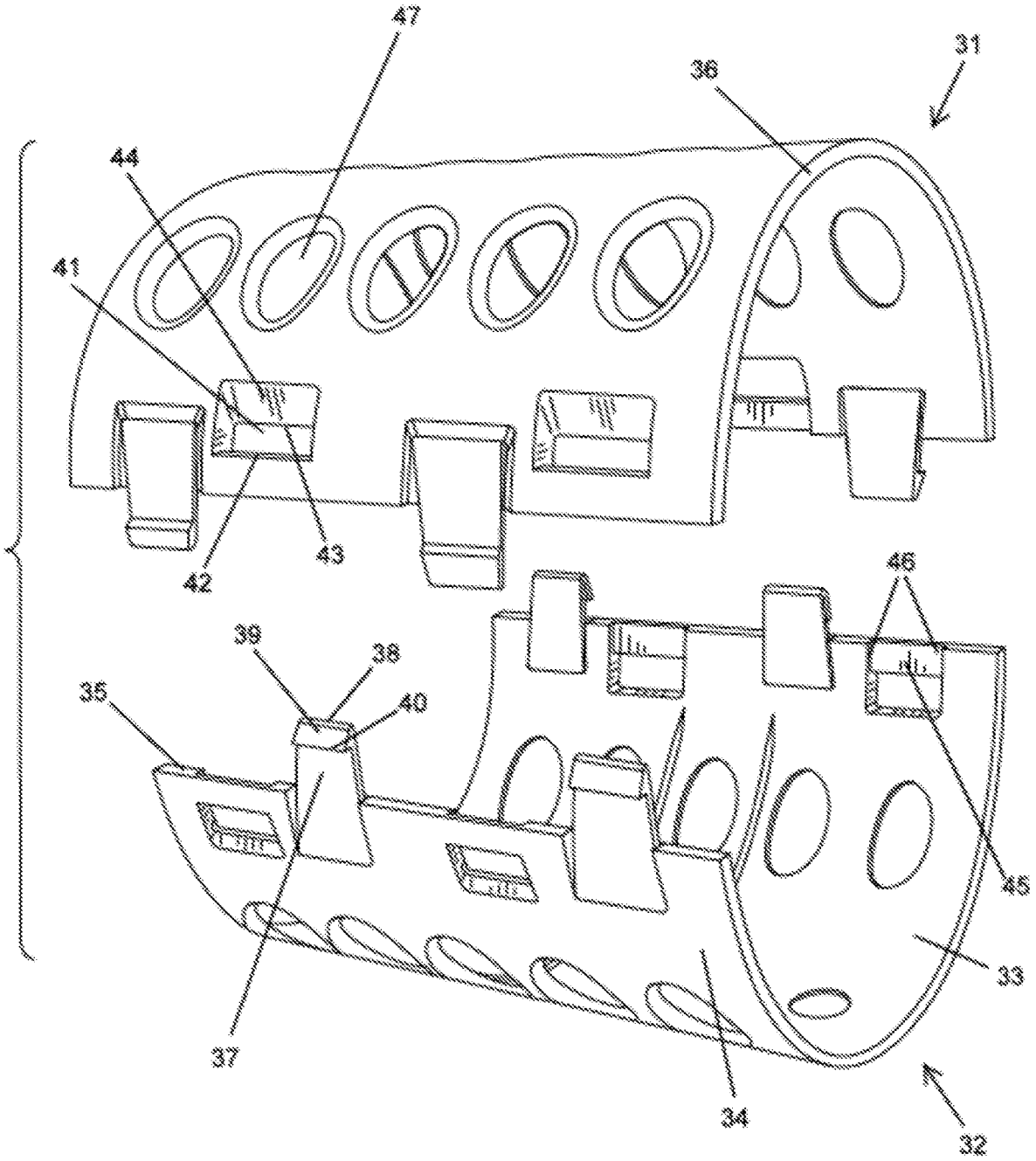
FIG. 4 is a side perspective view of a third embodiment of a hair roller of the invention in disassembled form with symmetrical half-cylindrical roller pieces with extended tabs with wedge shaped protuberances and corresponding orifices per side.

FIG. 4 is a side perspective view of an example of a third embodiment of a hair roller of the present invention, in disassembled form, separated into two component parts, symmetrical half-cylindrical roller pieces 31 and 32. The hair roller has an inner surface 33 and an outer surface 34. Each half-cylindrical roller piece 31 and 32 has a lateral edge 35 on each side and a half-circular end 36 on each end. Both half-cylindrical roller pieces are made of resilient flexible material and are essentially identical in shape. The half-cylindrical roller pieces 31 and 32 are shown separated by a gap. The hair roller includes mating devices configured to selectably couple the hair rollers and their components together. Each mating device is composed of a modified version of the complementary "male" and "female" configurations illustrated in the preceding figures. Each modified "male" configuration comprises a tab 37 extending from the lateral edge 35 with a distal end 38 and protuberance 39 on the outer surface of the tab 37, wherein the protuberance 39 has a proximal edge 40 where it is the thickest and tapers down in thickness to the distal end 38 of the tab 37. The sides of each tab 37 also optionally taper in from the lateral edge 35 to the distal end 40 of each tab 37. The distal end 37 is optionally rounded to facilitate assembly. The tabs are optionally configured to angle inward, away from the outer surface 34 of the half-cylindrical roller piece 31 or 32 to facilitate assembly, and to ensure a better fit when the roller pieces are in a nested configuration. The protuberance 39 is optionally wedge shaped. Each "female" configuration comprises an orifice 41 in the half-cylindrical roller piece 31 or 32 near the lateral edge 35. The orifice 41 is an opening in the surface of each half-cylindrical roller piece 31 and 32 having a proximal edge 43 and a distal edge 42. The outer surface of each half-cylindrical roller piece 31 and 32 tapers down toward the proximal edge 43 of the orifice 41, forming a ramp 44. The inner surface 33 of each half-cylindrical roller piece 31 or 32 has a channel extending from each orifice 41 to the lateral edge 35. The channel is defined by a ledge 45 and rails 46 on either side of the ledge 45, where the sides of the corresponding tab fit in the channel, between the rails 46. Each tab 37 extends beyond the proximal edge 43 of the corresponding orifice 41 when the lateral edges 35 of the half-cylindrical roller pieces 31 and 32 are aligned. When half-cylindrical roller pieces 31 and 32 are assembled, the distal end 38 of each tab 37 is designed to extend from the inner surface of the other half-cylindrical roller piece out through the corresponding orifice 41, over the proximal edge 43 of the orifice 41 and onto the ramp 44. Together, the tapered shape of the protuberance 39 and ramp 44 allow the outer surface of protuberance 39 to be substantially flush with the outer surface 34 of the corresponding half-cylindrical roller piece 31 or 32. The distal end 38 of each tab 38 is optionally rounded, as shown, to facilitate insertion through the corresponding orifice 41. Each half-cylindrical roller piece includes air holes 47. The air holes 47 can be any size, shape, or distribution that facilitates movement of air through the roller pieces.

Figure 5:
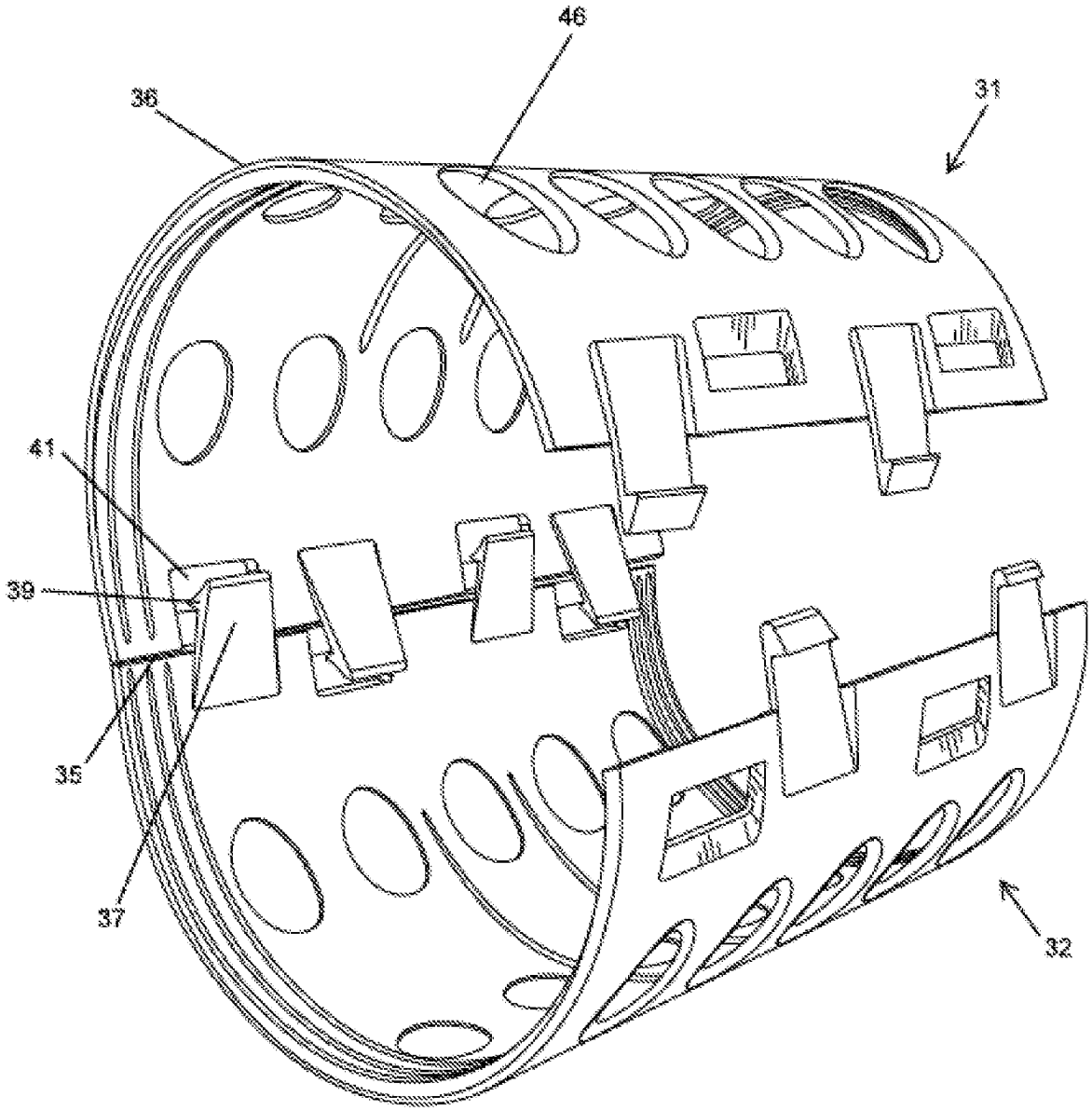
FIG. 5 is a side perspective view of the hair roller of FIG. 4 in a first step of assembly.

FIG. 5 is a side perspective view of the hair roller of FIG. 4 in a first step of an assembly process, in which one lateral edge 35 of each half-cylindrical roller piece 31 and 32 and the half-circular ends 36 on each end have been aligned so that each tab 37 is positioned so the protuberance 39 is positioned over a corresponding orifice 41. The first step of the assembly process can be carried out by positioning one side at a time, as shown, or by pressing inward on the both sides of each half-cylindrical roller piece 31 and 32 near each lateral edge 35, before bringing the two half-cylindrical roller pieces 31 and 32 together and aligning the lateral edges 35, then releasing the pressure on the outer surface of both roller pieces.

Figure 6:
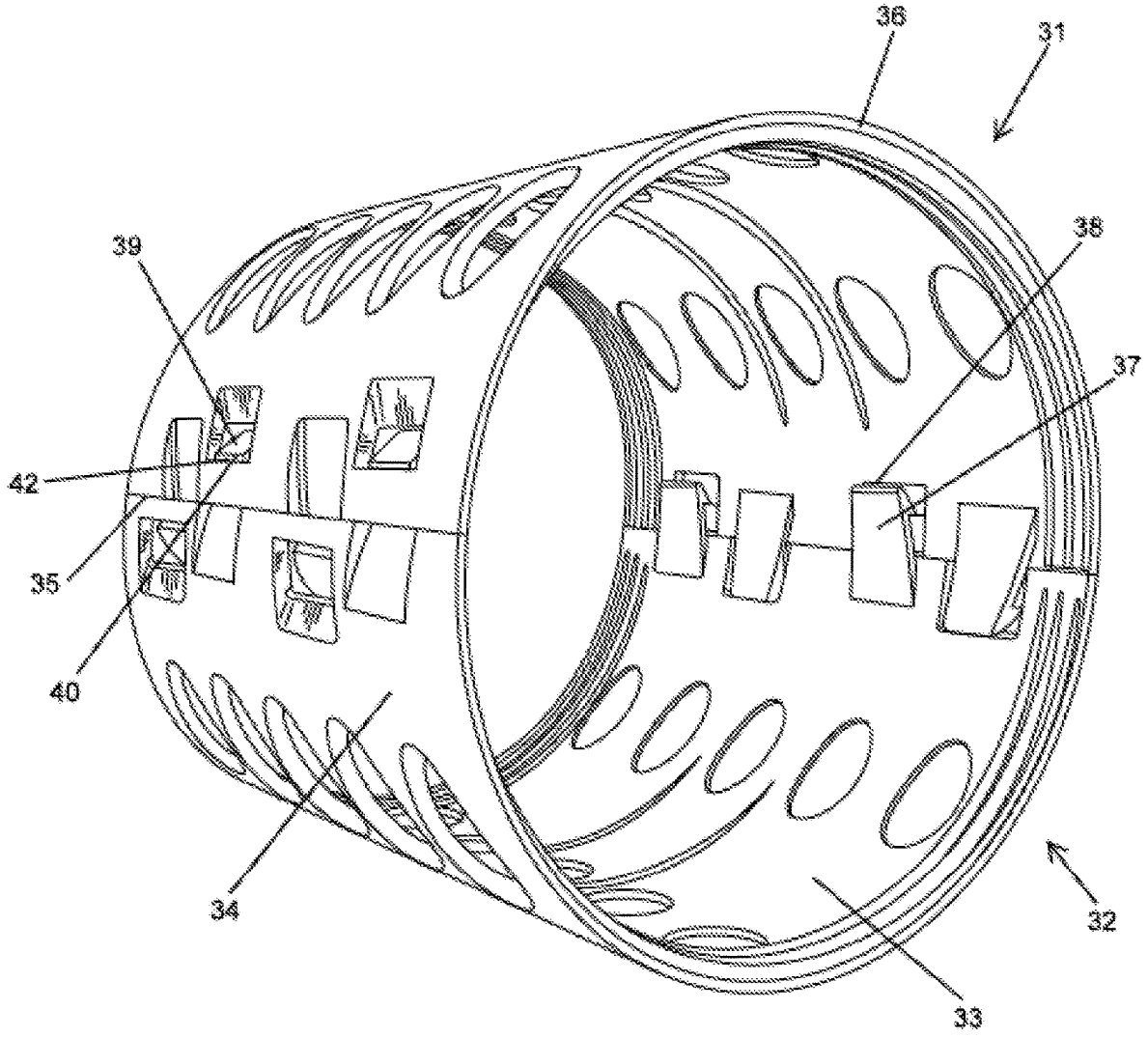
FIG. 6 is a side perspective view of the hair roller of FIG. 4 in a second step of assembly.

FIG. 6 is a front perspective view of the hair roller of FIG. 4 in the second stage of the assembly process, in which both lateral edges 35 and both half-circular ends 36 of half-cylindrical roller pieces 31 and 32 are aligned, the distal end 38 of each tab 37 is on the interior surface 33 of the corresponding half-cylindrical roller piece 31 or 32, and the proximal edge 40 of each protuberance 39 has been inserted into the corresponding orifice 41, where it is in contact with the distal edge 42 of the orifice 41.

Figure 7:
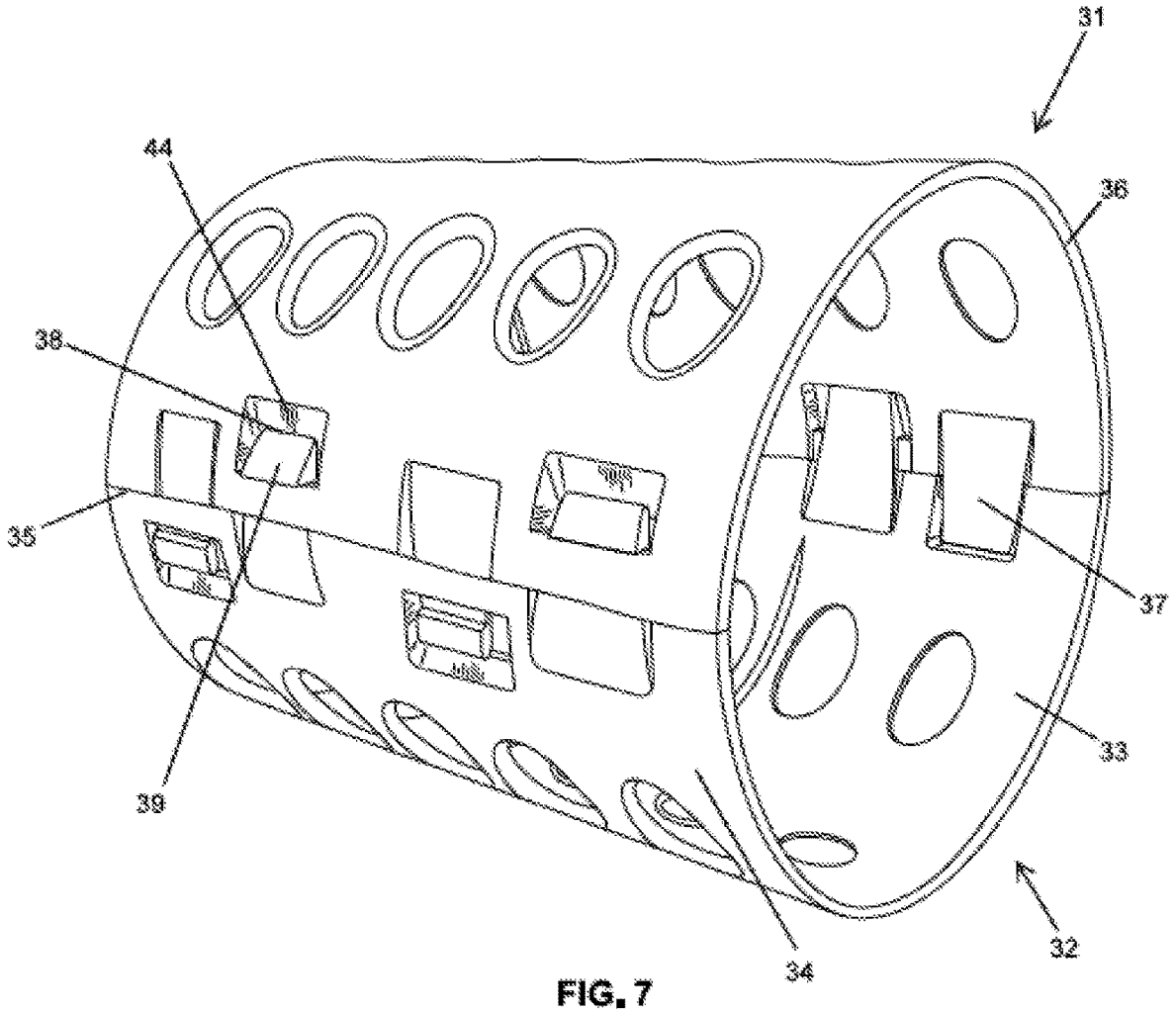
FIG. 7 is a side perspective view of the hair roller of FIG. 4 in assembled form.

FIG. 7 is a side perspective view of the hair roller of FIG. 4 after the final stage of assembly, when the distal end 38 of each tab 37 has been inserted through the corresponding orifice 41, over the proximal edge 43 of the orifice 41 and on to the surface of the ramp 44, thereby forming a secure relaxed-fit connection between the two half-cylindrical roller pieces 31 and 32. The two half-circular ends 31 form a whole circular end of the assembled hair roller. The assembled hair roller of FIG. 7 can easily be disassembled by pressing on the outer surface 34 of the hair roller where each set of lateral edges meet until the distal end 38 of each tab 37 exits the corresponding orifice 41, at which point, the half-cylindrical roller pieces 31 and 32 can be pulled apart, if they don't fall apart on their own.

Figure 8:
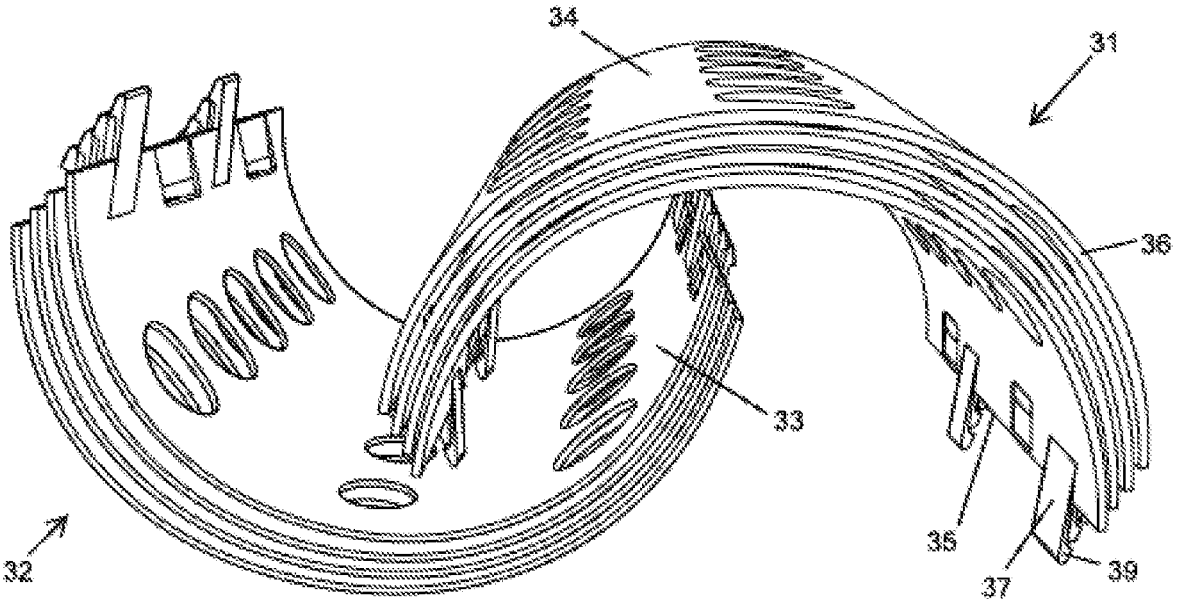
FIG. 8 is an end cross-section view of two nested stacks of half-cylindrical roller pieces of the invention stacked together with inner surfaces facing one another.

Any of the half-cylindrical roller pieces of the same embodiment of a hair roller of the invention can be nested with each other and with multiple other half-cylindrical roller pieces of the same shape and size. FIG. 8 is an end perspective view of two sets of nested half-cylindrical roller pieces 31 and 32 of FIG. 4 stacked on top of one another, with the inner surface 33 of each nested stack facing one another. Each nested stack has four half-cylindrical roller pieces stacked on top of one another, with lateral edges 35 and half-circular ends 36 aligned. The nested stack configuration enables many half-cylindrical roller pieces to be stored together in a compact way, taking up considerably less space than in their assembled form.

Figure 9:
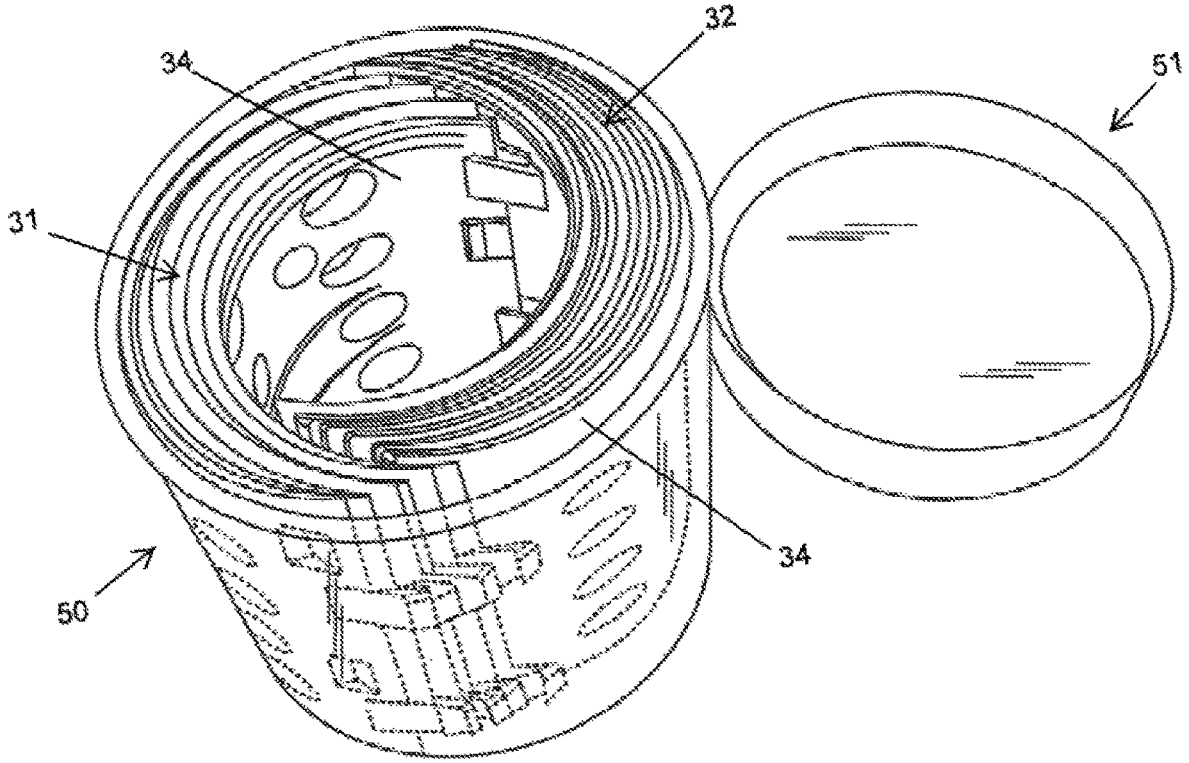
FIG. 9 is a top side perspective view of two nested stacks of half-cylindrical roller pieces of the same size in an open cylindrical container, with lid, according to an embodiment of the invention.

FIG. 9 is a top perspective view of two nested stacks of half-cylindrical roller pieces 31 and 32, such as illustrated in FIG. 8, in a single container 50 with an optional lid 51. This embodiment of the invention provides a very convenient, compact way to store half-cylindrical roller pieces of the invention, when the roller pieces are of the same size.

Disassembled hair roller sets of the present invention can include flexible resilient half-cylindrical bodies as components for several different hair rollers of various diameters. Half-cylindrical roller pieces can be nested within each other, as illustrated in FIG. 8 and stored in a singled container as illustrated in FIG. 9. Nested stacks of different sized roller pieces can also be stored in the same container, as illustrated in FIGS. 10 and 11.

Figure 10:
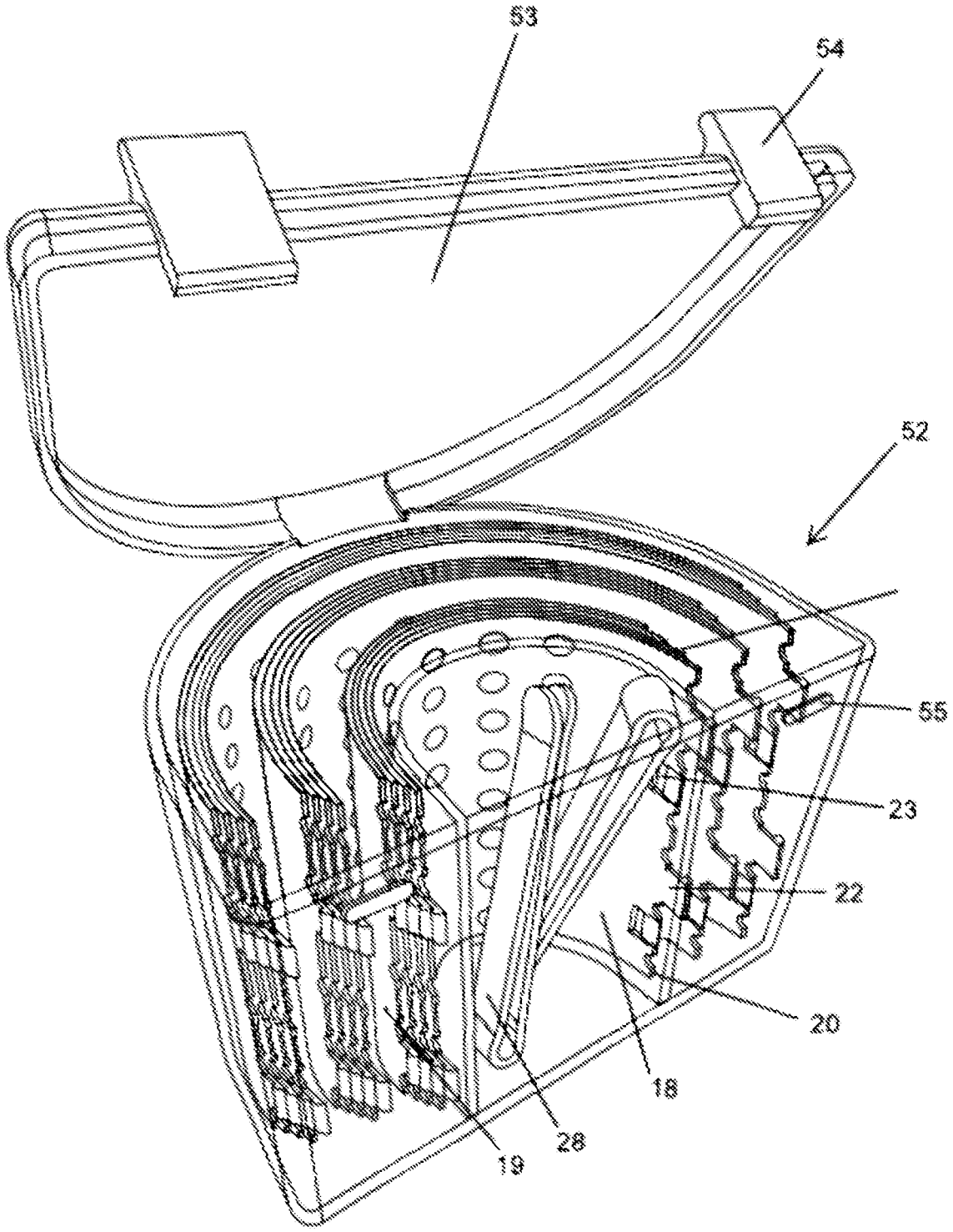
FIG. 10 is a front perspective view three of nested stacks of different sized half-cylindrical roller pieces with clip attachments in a container, with the container lid open, according to an embodiment of the invention.

FIG. 10 is an exploded view of a disassembled hair roller set of the embodiment illustrated in FIG. 3 with clip attachments 28, stored in an open container. The hair roller set includes disassembled hair rollers of three different sizes, with three different diameters. Each of the disassembled hair rollers shown in FIG. 10 consists of a pair of identical symmetrical half-cylindrical roller pieces. Each roller piece has a lateral edge 20 on each side, a half-circular end 21 on each end, and tabs 22 and orifices 23 on each side. The container 52, is designed to hold three different sizes of half-cylindrical roller pieces. The container 52 includes a lid 53, a latch 54, and latch catch 55. It includes a separate compartment for optional clip attachments 28, although items besides clip attachments could be placed in the additional compartment. The container 52 can be composed of any suitable material, not limited plastic, glass, and/or metal.

Figure 11:
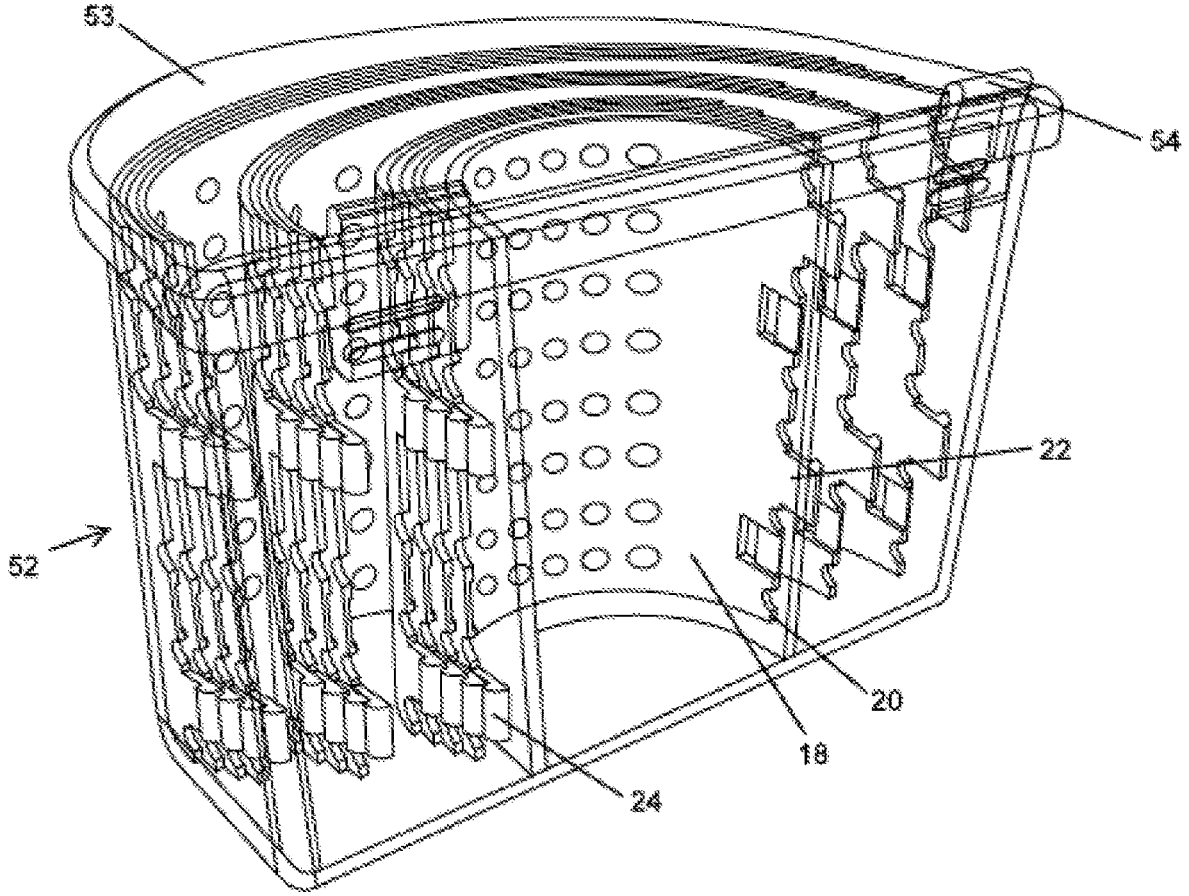
FIG. 11 is a front perspective view of the container of three nested stacks of half-cylindrical roller pieces of FIG. 10, without clip attachments, with the container lid closed.

FIG. 11 is an exploded view of the container 52 of the disassembled hair roller set of FIG. 10 with the lid 53 closed. The disassembled hair roller set stored in the container 52 may include flexible half cylindrical bodies as components of several different hair rollers of various diameters.

While particular embodiments of the present invention have been shown and described in some detail for clarity of understanding and by way of example, a variety of adaptations, changes and modifications will be obvious to those who are skilled in the art. Hence, the scope of the present invention is limited solely by the following claims.

We claim:

1. A hair roller comprising:

a whole cylindrical body separable into a pair of half-cylindrical roller pieces, wherein each of the half-cylindrical roller pieces represents a symmetrical division along a vertical axis of the whole cylindrical body;

wherein each half-cylindrical roller piece is separable from the other half-cylindrical roller piece along a lateral edge on each side of each half-cylindrical roller piece;

wherein each half-cylindrical roller piece is capable of being nested within the other half-cylindrical roller piece;

wherein each half-cylindrical roller piece includes a plurality of mating devices configured to selectably couple the pair of half-cylindrical roller pieces to form the whole cylindrical body;

wherein each mating device comprises a tab extending outward from the lateral edge of one half-cylindrical roller piece and an orifice near the lateral edge of the other half-cylindrical roller, wherein the tab includes a protuberance which protrudes from a surface of the tab into the orifice;

wherein the protuberance on each tab is on an outer surface of the tab;

wherein each protuberance has a proximal edge which engages a distal edge of the corresponding orifice, wherein the outer surface of the protuberance tapers down away from the proximal edge to the distal end of the tab, and the tab extends beyond a proximal edge of the corresponding orifice; and wherein the outer surface of the half-cylindrical roller piece is tapered toward the proximal edge of the orifice forming a ramp, and the inner surface of the distal end of the tab is positioned over the outer surface of the ramp.

2. The hair roller of claim 1, wherein the protuberance on one tab is on an inner surface of the tab and the protuberance on another tab is on an outer surface of the tab.

3. The hair roller of claim 1, wherein the protuberance and the orifice are both the same shape.

4. The hair roller of claim 1, wherein each half-cylindrical roller piece includes a plurality of air holes.

5. A method of storing at least one pair of half-cylindrical roller pieces of claim 1, comprising nesting the half-cylindrical roller pieces by placing the half-cylindrical roller pieces on top of one another, with an interior face of one half-cylindrical roller piece facing an outer surface of another half-cylindrical roller piece.

* * * * *